US006293545B1

(12) United States Patent
Hanks et al.

(10) Patent No.: US 6,293,545 B1
(45) Date of Patent: Sep. 25, 2001

(54) STRIPPER BLADE ASSEMBLY

(75) Inventors: David W. Hanks; Donald B. MacLane; Richard G. Chambers, all of Portland, OR (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/465,240

(22) Filed: Dec. 15, 1999

(51) Int. Cl.[7] ..... B65H 29/54
(52) U.S. Cl. ..... 271/311; 271/900; 347/104
(58) Field of Search ..... 101/118, 232; 347/103, 104; 346/134, 138; 399/398, 399, 323; 271/900, 307, 308, 311, 312

(56) References Cited

U.S. PATENT DOCUMENTS 4,000,694 * 1/1977 Schroder ..... 101/365
4,119,308 * 10/1978 Hamaker ..... 271/174
4,387,981 * 6/1983 Cormier ..... 355/3 SH
5,570,775 * 11/1996 Kleinhans et al. ..... 198/635
5,676,054 * 10/1997 Lubke et al. ..... 101/169
5,996,900 * 12/1999 Kawashima ..... 271/122

* cited by examiner

*Primary Examiner*—John S. Hilten
*Assistant Examiner*—Kevin P. Williams

(57) ABSTRACT

A stripper blade assembly for an ink jet offset printer has a thin blade fixedly mounted on a top surface of a blade holder. The blade holder includes at a trailing edge flexible eyelet portions that extend downwards to snap over protuberances on mechanical connectors overmolded onto a rotatable shaft in order to secure the blade holder to the shaft. The thin blade engages the surface of an offset drum of the ink jet offset printer along the width of the drum at an appropriate point in the print process to strip the leading edge of a print medium from the offset drum surface, minimizing damage to the offset drum surface and to the printed image on the print medium while also minimizing the risk of a jam.

10 Claims, 5 Drawing Sheets

STRIPPER BLADE ASSEMBLY

BACKGROUND OF THE INVENTION

The present invention relates to ink jet offset printers, and more particularly to a stripper blade assembly for removing a print medium from the surface of an offset drum in an ink jet offset printer.

In an offset print process an intermediate image is printed onto a print surface of a drum, the print surface generally being a release agent coated on the surface of the drum. The intermediate image is then transferred from the print surface onto a print medium, such as paper or transparency material, in a transfer fusing process. Such a transfer fusing process causes the print medium to tend to adhere to the surface of the drum. Typically in the industry the print medium is stripped from the drum with multiple, spring loaded, plastic fingers that are presented to the drum and print medium at a specified time in the print process. If there is any damage to the print medium, such as a bent comer, a bent leading edge, a cut medium, etc., or any other error in the print process at this critical juncture, the result is a serious jam that is difficult to clear and requires an expensive service call. Also the plastic fingers may damage the drum and cause damage to the printed image on the print medium due to the point loading.

What is desired is a stripper assembly that removes a print medium from an offset drum of an ink jet offset printer without damage to the printed image on the print medium or to the drum and without risk of a serious jam.

BRIEF SUMMARY OF THE INVENTION

Accordingly the present invention provides a stripper blade assembly for removal of a print medium from an offset drum of an ink jet offset printer that uses a thin, durable, flexible blade. The stripper blade assembly may be easily removable and installable by a customer. The blade, that extends the width of the drum, is mounted on a blade holder. The blade holder is detachably mounted on a shaft having an overmolded connector. The entire assembly rotates or otherwise moves to present the thin edge of the blade to the drum along the axial length of the drum in order to strip the leading edge of the print medium from the drum at the appropriate point in the print process.

The objects, advantages and other novel features of the present invention are apparent from the following detailed description when read in conjunction with the appended claims and attached drawing.

DETAILED DESCRIPTION OF THE INVENTION

Figure 1:
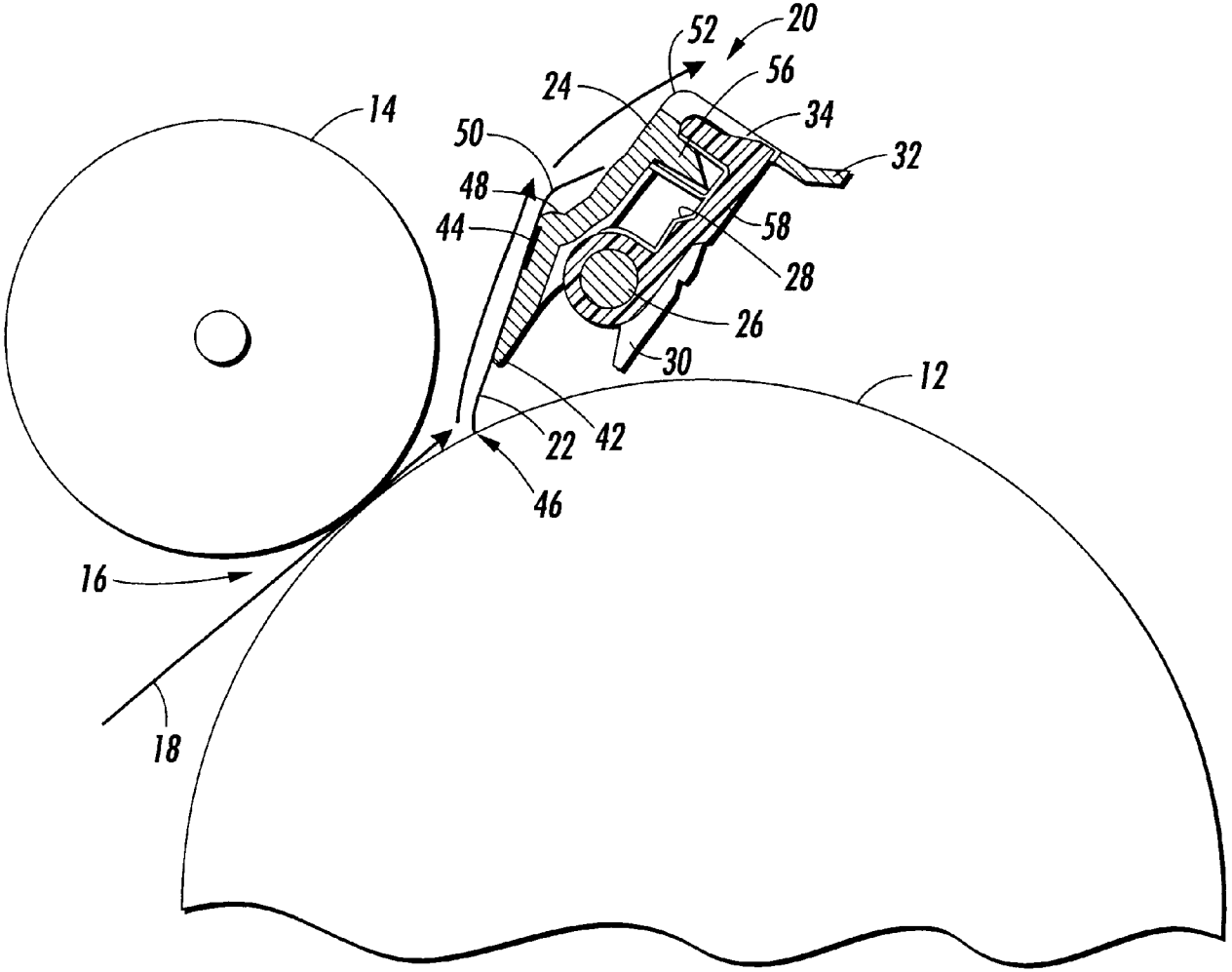
FIG. 1 is a partial sectional view of a stripper blade assembly according to the present invention.
Figure 2:
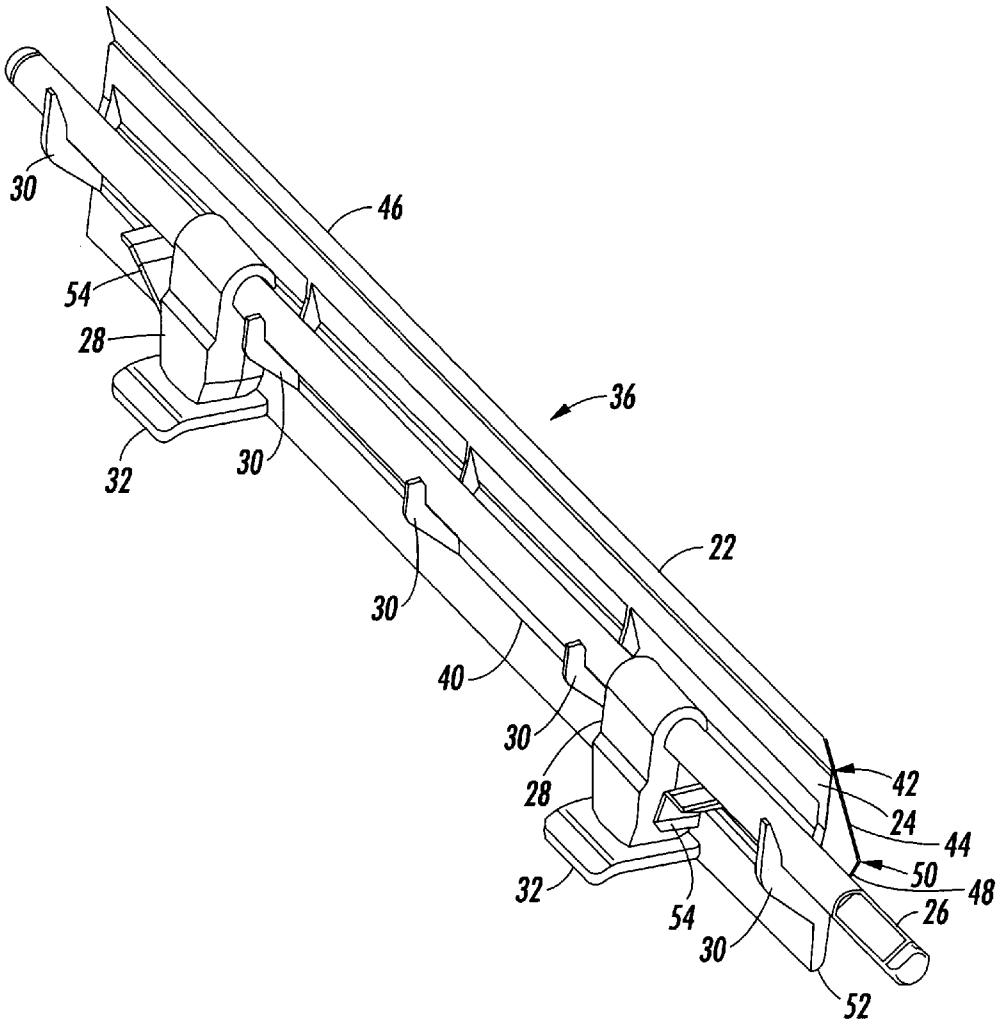
FIG. 2 is a bottom side perspective view of a stripper blade assembly according to the present invention.
Figure 3:
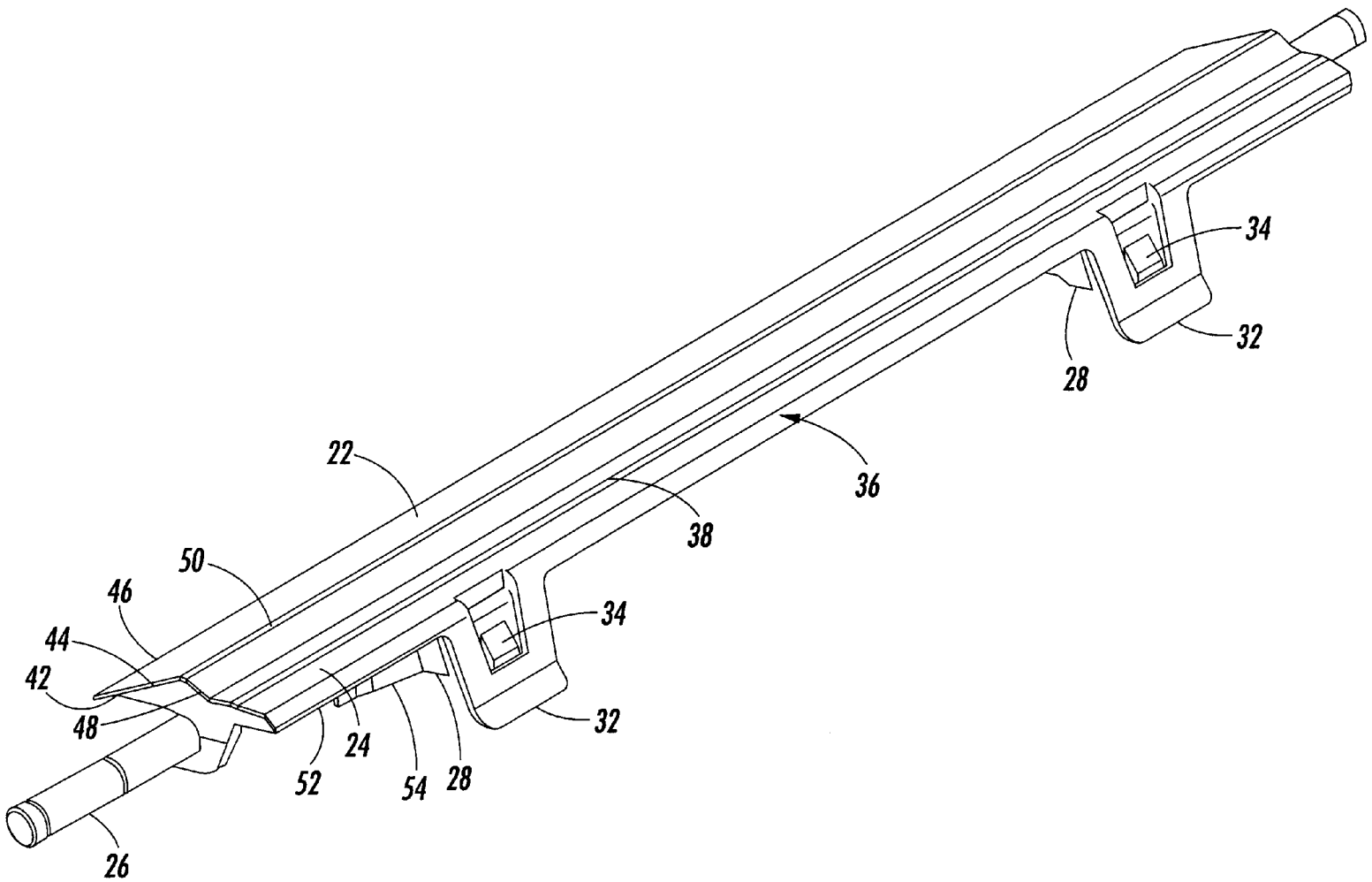
FIG. 3 is a top side perspective view of a stripper blade assembly according to the present invention.
Figure 4A:
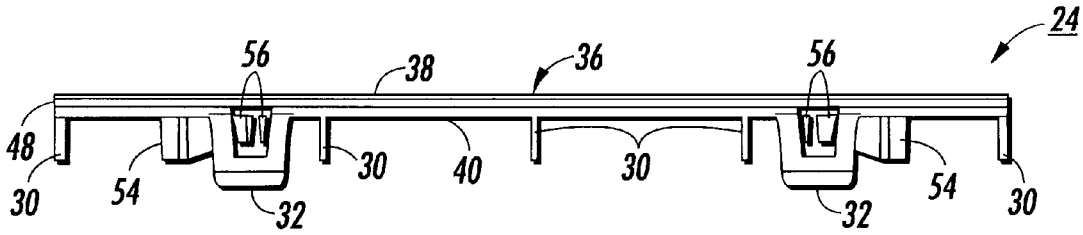
FIGS. 4A, 4B and 4C are respective back, bottom and side plan views of a blade holder for the stripper blade assembly according to the present invention.
Figure 4B:
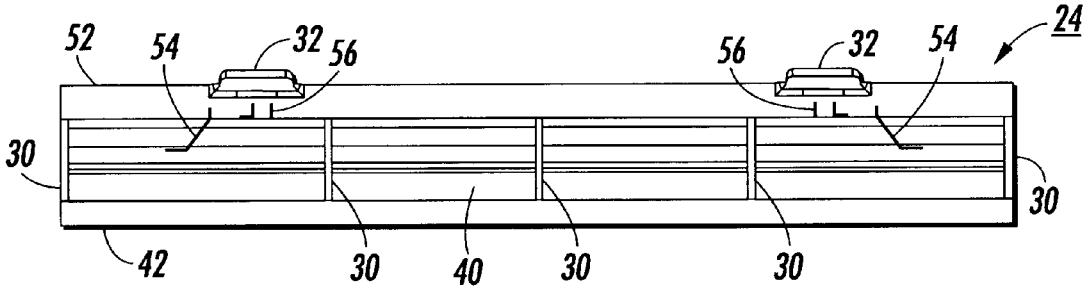
Figure 4C:
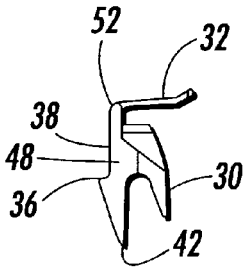
Figure 5A:
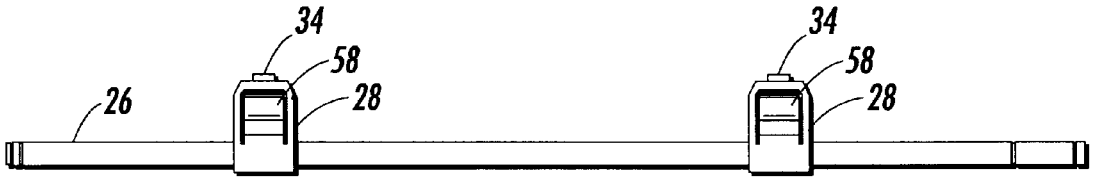
FIGS. 5A, 5B and 5C are respective bottom, top and end plan views of a shaft with connectors for the stripper blade assembly according to the present invention.
Figure 5B:
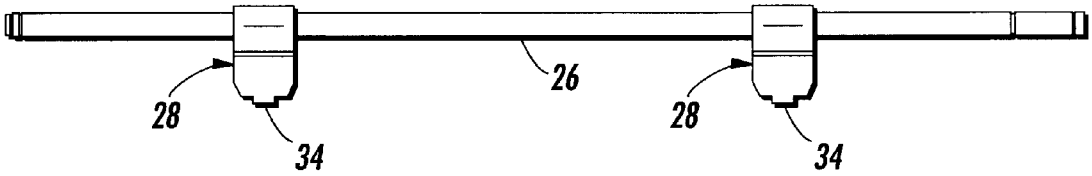
Figure 5C:
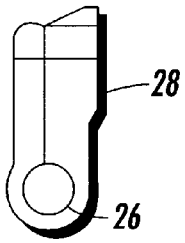

Referring now to FIGS. 1–5 an offset drum 12 is shown with a transfer roller 14 which together form a nip 16 through which a print medium, such as paper or transparency material, passes along a medium path 18. A stripper blade assembly 20 includes a thin blade 22 fixedly mounted on a blade holder 24. The blade holder 24 may be detachedly mounted on a shaft 26 via connectors 28 that are fixedly mounted on the shaft, such as by an overmolding process. The blade holder 24 has guide ribs 30 with slots that fit over the shaft 26. The blade holder 24 also has a flexible eyelet portion 32 that engages a protuberance 34 on the connectors 28 to secure the blade holder to the shaft 26.

The blade holder 24 has a main body 36 with a top surface 38 and a bottom surface 40. The thin blade 22 is fixedly attached to the top surface 38 via a suitable adhesive 44 that is compatible with the materials of both the blade holder 24 and the thin blade. A leading edge 46 of the thin blade 22 extends beyond a leading edge 42 of the top surface 38 of the blade holder 24. The adhesive 44 may be in the form of a double-sided sticky tape. The top surface 38 also includes a longitudinal ledge 48. The thin blade 22 includes a corresponding longitudinal bend 50 that overhangs the ledge 48 to provide a smooth transition of the medium path 18 over the top of the blade holder 24. For detachability the flexible eyelet portion 32 extends down from the bottom surface 40 at the trailing edge 52 to engage the protuberance 34 on the connector 28 mounted on the shaft 26. Also on the bottom surface 40 are a pair of opposing guide rails 54 that guide the blade holder 24 into alignment longitudinally such that the flexible eyelet portions 32 engage the connector protuberances 34. The bottom surface 40 also includes guide posts 56 adjacent the flexible eyelet portions 32 that fit into a recess 58 in the connectors 28. Alternatively the blade holder 24 may be fixedly attached to the shaft 26 by suitable means.

In operation the guide ribs 30 of the blade holder 24 engage the shaft 26 via the slots, and the blade holder is rotated until the flexible eyelet portions 32 snap over the protuberances 34 of the connectors 28 to secure the blade holder to the shaft. The stripper blade assembly 20 is generally kept clear of the drum 12, but when the print medium passes through the transfer nip 16, the shaft 26 rotates to bring the thin blade 22 in contact with the drum 12 along the width of the drum to detach the leading edge of the print medium from the drum. Alternatively the entire assembly 20 may be moved linearly to bring the thin blade 22 in contact with the drum 12. Once the leading edge of the print medium is detached from the drum 12, the stripper blade assembly 20 then moves away from the drum and the print medium passes over the blade holder 24 to exit the printer along the medium path 18. In the detachable configuration to remove the blade holder 24 from the shaft 26, the flexible eyelet portions 32 are lifted from the protuberances 34 and the body 36 is rotated to clear the connectors 28. The blade holder 24 is then pulled back from the shaft 26, disengaging the guide ribs 30 from the shaft, to complete the removal.

The material of the thin blade 22 needs to be flexible, but durable; needs to be compatible with the ink chemistry of the printer, as vapor from the ink is present; and needs to be heat resistant. One such material includes a Mylar/polyester material. The thickness of the material may be 0.005" to 0.020". The length of the material is sufficient to engage the entire leading edge of the final print medium, such as 8.75" for A and A4 size printers. The bend 50 in the thin blade material is formed thermally to provide a smooth bend in order to avoid any sharp edges that might scrape the ink surface of the print medium. Likewise the material of blade holder 24, which may be a plastic molding, needs to have dimensional stability and be moldable; needs to be compatible with the ink chemistry of the printer; and needs to be heat resistant. Finally the materials of the thin blade 22 and the blade holder 24 need to be compatible with the adhesive 44 used to assure a secure attachment of the thin blade to the blade holder.

Because a continuous surface in the form of the thin blade 22 is presented to the print medium, any resulting load against the printed image is more evenly distributed than with the prior art fingers, and damage to the printed image is minimized. Also due to the continuous surface being laid down on the surface of the drum 12, the stripper blade assembly 20 is capable of stripping print medium that has been severely damaged. Further because the stripping edge of the thin blade 22 distributes the load along the long edge instead of point loading by small fingers, the damage to the drum 12 is minimal and acceptable. In the unlikely event of a jam, the jam will be easier to clear and will not be as serious as is the case with individual fingers which may shred the medium. Finally the detachability of the blade holder 24 makes access to any jams easier.

Thus the present invention provides a stripper blade assembly 20 for an ink jet offset printer that has a thin blade 22 fixedly attached to a blade holder 24 that in turn may be removably attached to a shaft 26, which at the appropriate point in the print process engages the drum 12 along its axial length to strip the leading edge of the print medium from the surface of the drum while minimizing damage to the drum or medium and reducing the risk of jams.

What is claimed is:

1. A stripper blade assembly for an ink jet printer having an offset drum comprising:

a rotatable shaft; and a mechanical connector fixedly attached to the rotatable shaft;

a blade holder including a body having a top surface, a bottom surface, and means fixedly mounted to the bottom surface for detachably attaching the body to the mechanical connector; and a thin blade fixedly mounted to the top surface of said body such that, when contacted to the drum at an appropriate point in a print process, the thin blade engages an entire leading edge of a print medium on the offset drum to strip the print medium therefrom;

wherein the body further comprises a plurality of ribs, each having a slot, fixedly mounted on the bottom surface for interacting with the rotatable shaft when the body is attached thereto.

2. The stripper blade assembly as recited in claim 1 wherein the body further comprises guide means fixedly attached to the bottom surface to guide the detachably attaching means to interact with the mechanical connector to secure the body on the rotatable shaft.

3. The stripper blade assembly as recited in claim 1 further comprising means for fixedly attaching the thin blade to the top surface of the body.

4. The stripper blade assembly as recited in claim 3 wherein the fixedly attaching means comprises a double sided, sticky tape.

5. The stripper blade assembly as recited in claim 1 wherein the material of the thin blade comprises a Mylar/polyester material.

6. The stripper blade assembly as recited in claim 1 wherein an edge of the thin blade has a thickness between 0.005 and 0.020 inches.

7. The stripper blade assembly as recited in claim 1 wherein the mechanical connector is overmolded onto the rotatable shaft to fixedly attach the mechanical connector to the rotatable shaft.

8. The stripper blade assembly as recited in claim 1 wherein the mechanical connector has a protuberance and the detachably attaching means has a flexible eyelet that snaps over the protuberance to attach the body to the rotatable shaft.

9. The stripper blade assembly as recited in claim 1 wherein the thin blade comprises a thin, rectangular piece of flexible material having a longitudinal leading edge and having a longitudinal bend toward a rear edge opposite the leading edge.

10. The stripper blade assembly as recited in claim 9 wherein the body has a longitudinal ledge corresponding to the longitudinal bend in the thin, rectangular piece of flexible material such that, when the thin, rectangular piece of flexible material is fixedly mounted on the body, the rear edge overhangs the longitudinal ledge to guide the print medium smoothly from the offset drum along a print medium path in the printer.

* * * * *